US006790070B1

(12) United States Patent
England, II

(10) Patent No.: US 6,790,070 B1
(45) Date of Patent: Sep. 14, 2004

(54) APPARATUS FOR LOCKING A PLUG

(75) Inventor: Donald H. England, II, Patuxent River, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/657,856

(22) Filed: Sep. 10, 2003

(51) Int. Cl.[7] ..... H01R 13/639
(52) U.S. Cl. ..... 439/372; 439/345; 439/305
(58) Field of Search ..... 439/372, 305, 439/310, 324, 345, 299

(56) References Cited

U.S. PATENT DOCUMENTS 3,221,288 A * 11/1965 Eads ..... 439/299
4,919,627 A * 4/1990 Cable ..... 439/372
5,622,064 A 4/1997 Gluskoter et al.
6,461,185 B2 * 10/2002 James ..... 439/352
6,480,611 B2 11/2002 Hashimoto et al.

* cited by examiner

*Primary Examiner*—Renee Luebke
(74) *Attorney, Agent, or Firm*—Mark O. Glut

(57) ABSTRACT

An apparatus for locking a plug for use with a plug and a plug signal receptacle for prevention of intentional or inadvertent removal of a plug.

7 Claims, 4 Drawing Sheets

APPARATUS FOR LOCKING A PLUG

STATEMENT OF GOVERNMENT INTEREST

The invention described herein may be manufactured and used by or for the Government of the United States of America for governmental purposes without payment of any royalties thereon or therefor.

BACKGROUND

The present invention relates to an apparatus for locking a plug. More specifically, but without limitation, the present invention relates to an apparatus for locking an audio headphone plug.

Current plug signal receptacles do not securely lock plugs in place to prevent unauthorized or accidental removal. Often plugs are inadvertently or intentionally removed by unauthorized personnel. Removal of plugs could cause disruption of service that is being provided by the plugs (service could include, but without limitation, audio and/or video feed).

Furthermore, plugs and their respective attachments are often stolen, specifically, but without limitation, if audio headphones are to be used by the public in a public venue such as a concert hall, sports arena, or mall kiosk. Because of this high probability of theft, public venues often do not offer audio headphones, and typically have all announcements broadcast over a loudspeaker system that is often inaudible or difficult to understand. Having a mechanism that could secure plugs, specifically headphone plugs, venues could offer additional services, such as for example, but without limitations, clear play-by-play announcements at sporting events or enhanced sound at concerts.

Thus, there is a need in the art to provide a method or mechanism that incorporates the listed benefits without the limitations inherent in present methods. For the foregoing reasons, there is a need for an apparatus for locking a plug.

SUMMARY

The instant invention is directed to an apparatus for locking a plug, specifically an apparatus for use with a plug and a plug signal receptacle. The apparatus for locking a plug includes a plug lock, a plug lock spring, a locking release mechanism, and a plug lock locking mechanism. The plug lock is rotatably secured about a first selected point or axis, and the plug lock rotates about the first selected point or axis as the plug enters the plug signal receptacle. The plug lock communicates with the plug lock spring such that the plug lock spring applies force on the plug lock such that the plug lock returns to a neutral position after the plug is fully engaged in the plug signal receptacle. The neutral position being the position where the plug lock is substantially perpendicular to the plug signal receptacle. The locking release mechanism is rotatably secured about a second selected point or axis; the locking release mechanism communicates with the plug lock such that when the plug lock rotates about the first selected point or axis the locking release mechanism rotates about the second selected point or axis. The plug lock locking mechanism communicates with the locking release mechanism such that when the locking release mechanism rotates about the second selected point or axis the plug lock locking mechanism secures the plug lock in the neutral position, and the plug lock then retains and holds the plug securely in the plug signal receptacle.

The present invention is directed to an apparatus for locking a plug that can secure a plug in its respective plug signal receptacle.

The present invention is directed to an apparatus for locking a plug that prevents inadvertent or intentional removal by unauthorized personnel.

It is an object of the invention to provide an apparatus for locking a plug that can allow a venue to provide additional audio (or video) services via a secured headphone system.

DRAWINGS

These and other features, aspects and advantages of the present invention will become better understood with reference to the following description and appended claims, and accompanying drawings wherein:

DESCRIPTION

Figure 2:
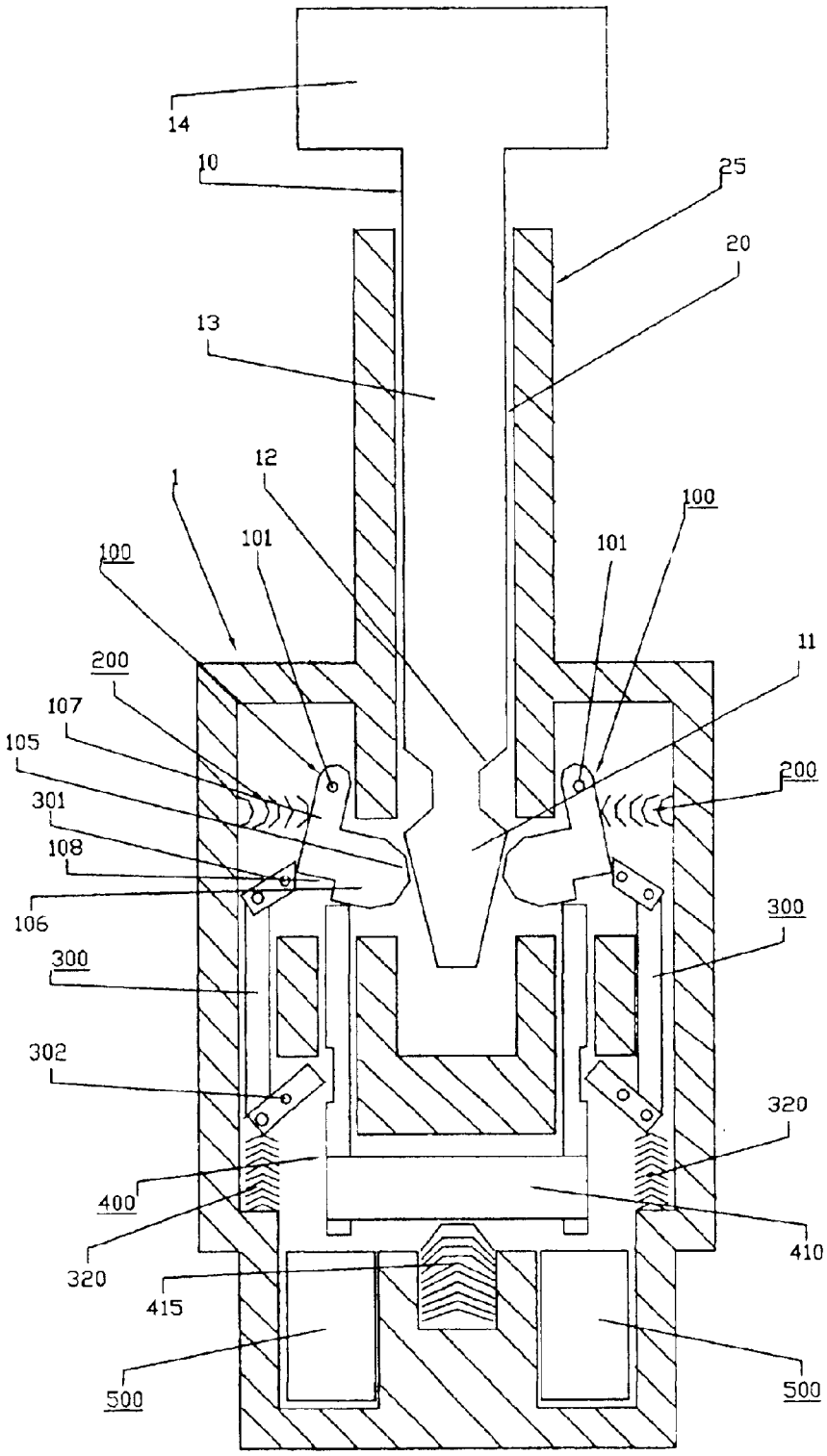
FIG. 2 is an internal side view of an embodiment of the apparatus for locking a plug with the plug partially entering the plug receptacle.
Figure 3:
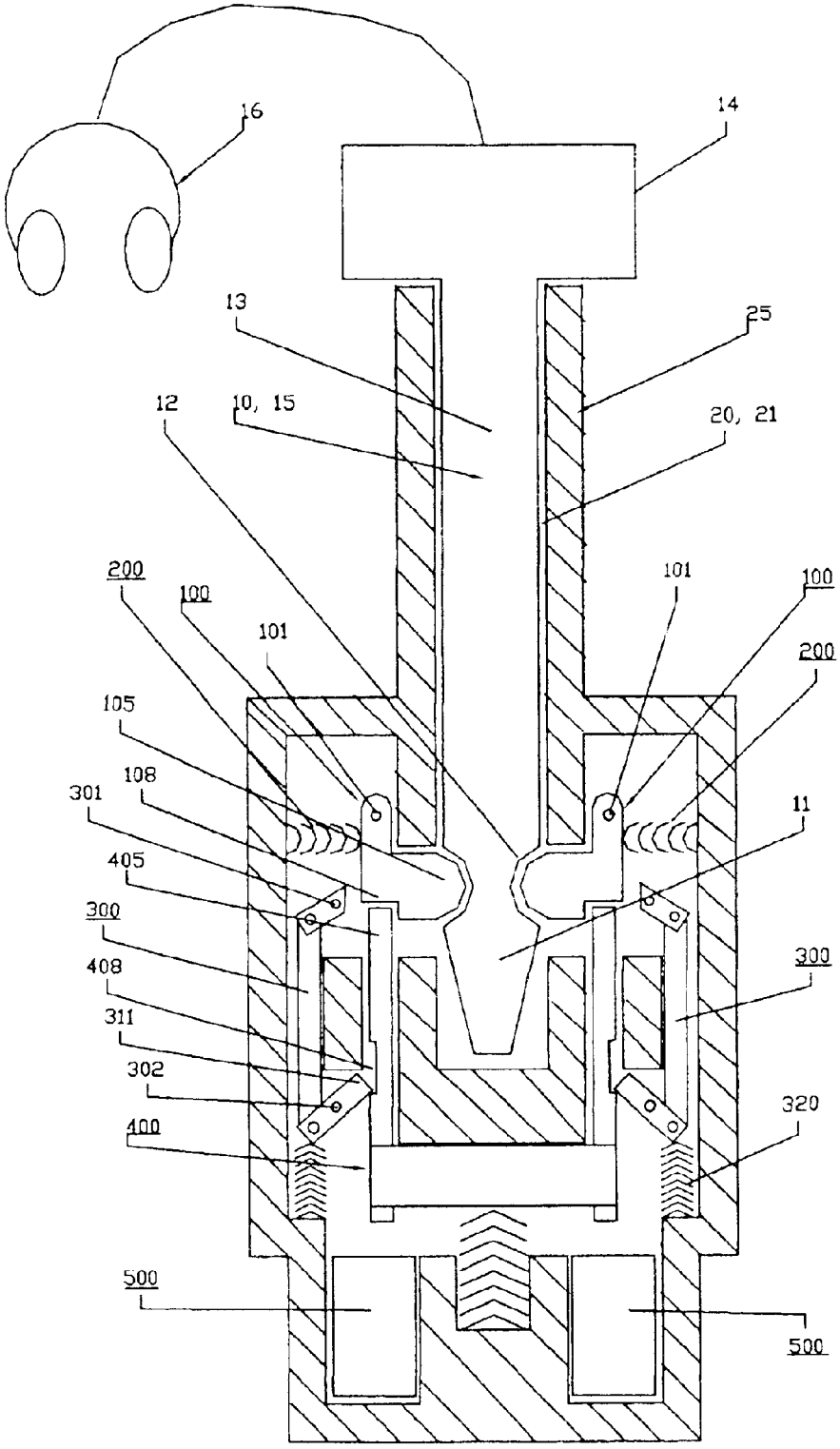
FIG. 3 is an internal side view of an embodiment of the apparatus for locking a plug with the plug fully engaged in the plug receptacle.

The preferred embodiments of the present invention are illustrated by way of example below and in FIGS. 1–4. The apparatus for locking a plug 1 is for use with a plug 10 and a plug signal receptacle 20 (and/or plug signal receptacle housing 25). Typically, plugs 10 have a substantially circular cross section and the plug signal receptacle 20 has a corresponding shape in order to accept the plug 10. Also, in a typical plug-receptacle configuration when the plug 10 is fully inserted in the plug signal receptacle 20 both the plug 10 and plug signal receptacle 20 are substantially axially aligned. The plugs 10 may be headphone plugs or audio headphone signal plugs 15 attached to a headphone 16, while the plug signal receptacle 20 may be an audio signal receptacle or a headphone plug signal receptacle 21. As seen in FIGS. 2 and 3, the standard plug 10 typically has a truncated conic section tip 11, with an indentation 12 just past the end of the truncated conic section tip 11. The indentation 12 is typically disposed around the entire cross section of the plug 10. The remaining portion of the plug 10 is typically a shaft 13 and an end portion 14 having a larger cross section than the shaft 13. The end portion 14 and the truncated conic sect tip 11 are typically on opposite ends of the shaft 13.

In the discussion of the present invention, the invention will be discussed in an audio headphone environment; however, this invention can be utilized for any type of need that requires a plug lock, specifically, but without limitation, in audio, video or any type of electronic feed that requires a plug lock.

Figure 1:
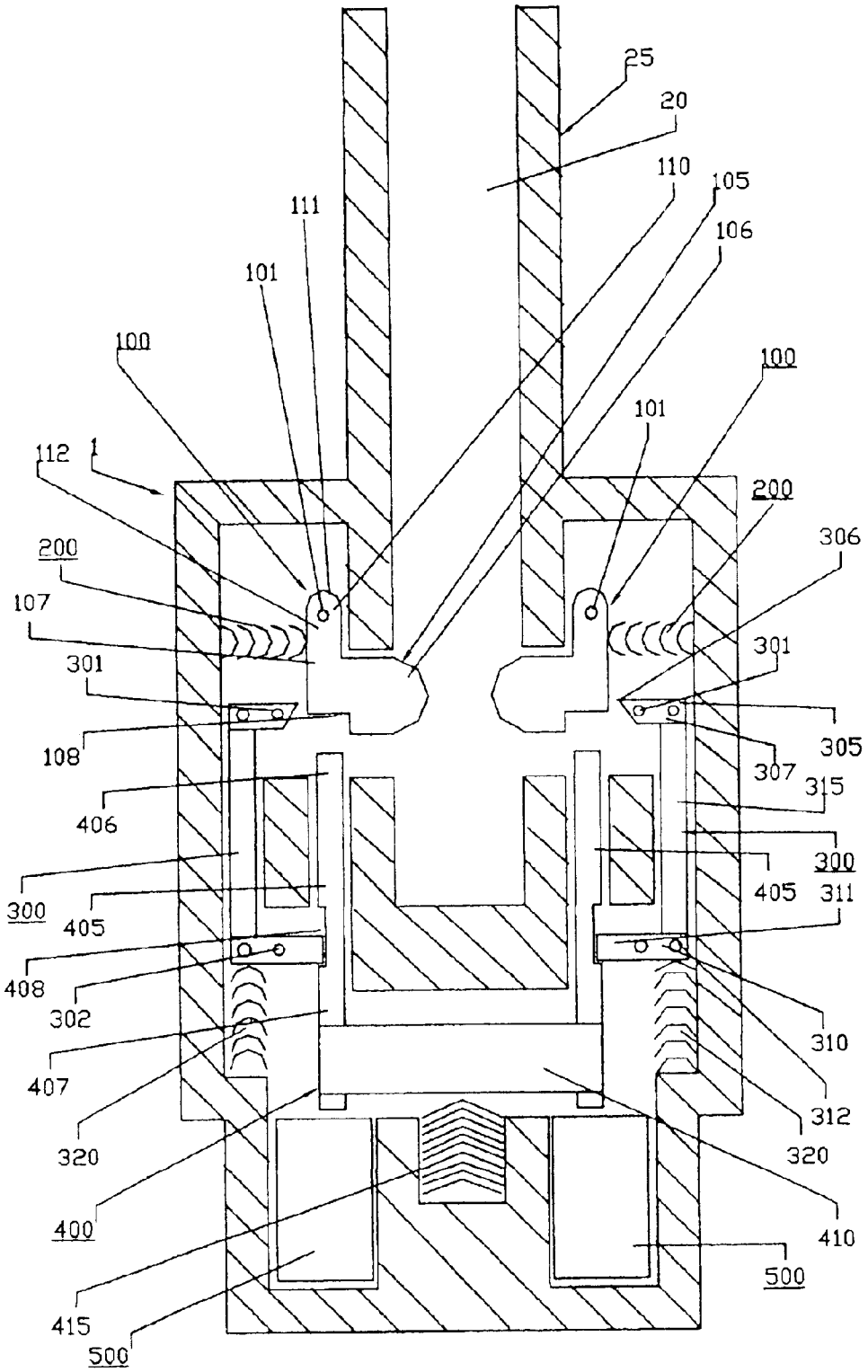
FIG. 1 is an internal side view of an embodiment of the apparatus for locking a plug.
Figure 4:
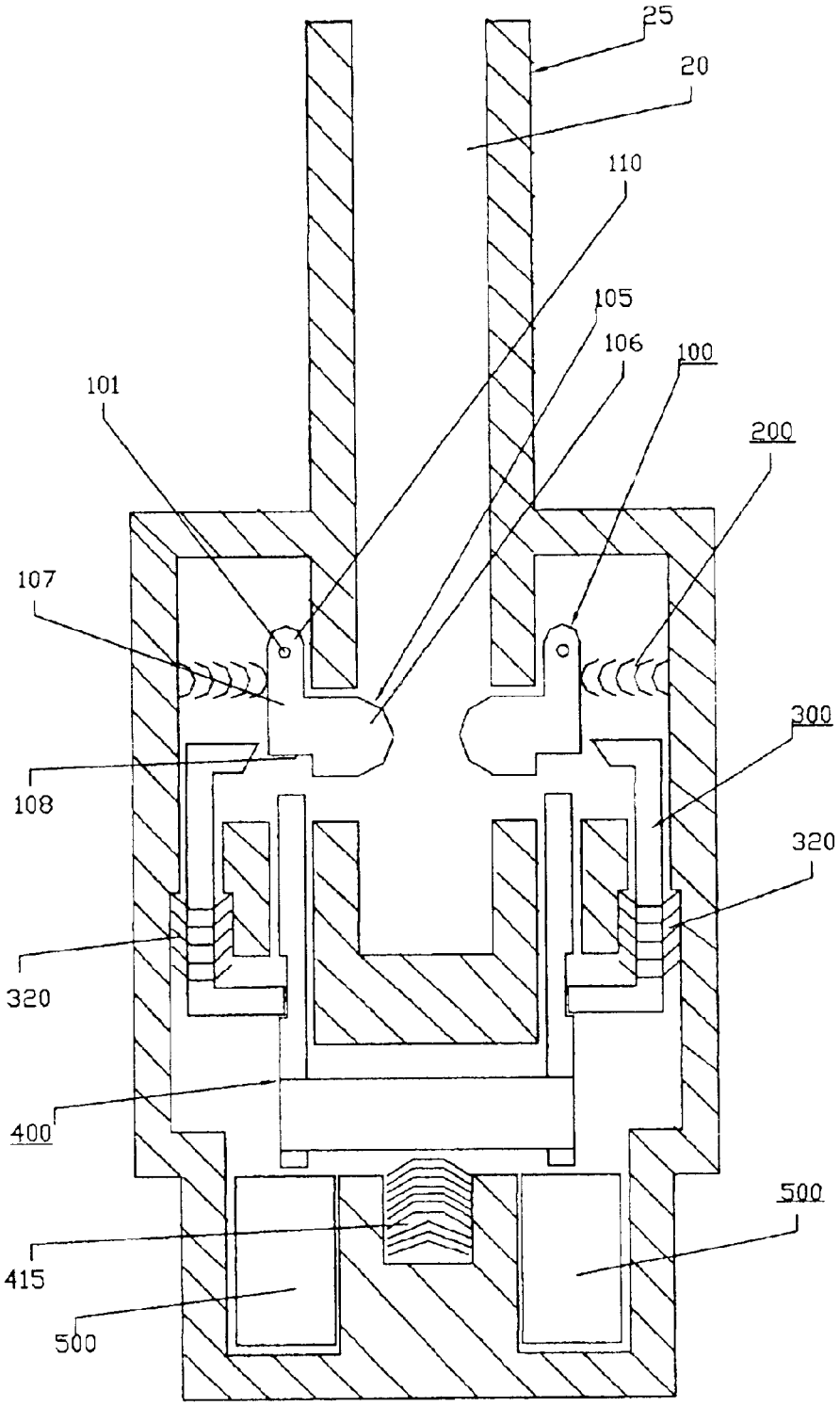
FIG. 4 is an internal side view of an embodiment of the apparatus for locking a plug.

As seen in FIG. 1, the apparatus for locking a plug 1 includes a plug lock 100, a plug lock spring 200, a locking release mechanism 300, and a plug lock locking mechanism 400. The plug lock 100 is rotatably secured about a first selected point or axis 101. In operation, as s en in FIG. 2, the plug lock 100 rotates about the first selected point or axis 101 as the plug 10 (or headphone plug 15) enters the plug signal receptacle 20 (or audio signal receptacle 21). The plug lock spring 200 communicates with the plug lock 100 such that the plug lock spring 200 applies force on the plug lock 100 such that the plug lock 100 returns to a neutral position after the plug 10 is fully engaged in the plug signal receptacle 20. The neutral position, as shown in FIGS. 1, 3 and 4, may be defined, but without limitation, as the position where the plug lock 100 is substantially perpendicular to the plug signal receptacle 20 or the plug 10 itself. The locking release mechanism 300 is rotatably secured about a second selected point or axis 301. The locking release mechanism 300 communicates with the plug lock 100 such that when the plug lock 100 rotates about the first selected point or axis 101 the locking release mechanism 300 rotates about the second selected point or axis 301. The plug lock locking mechanism 400 communicates with the locking release mechanism 300 such that when the locking release mechanism 300 rotates about the second selected point or axis 301 the plug lock locking mechanism 400 secures the plug lock 100 in the neutral position, and the plug lock 100 then retains and holds the plug 10 securely in the plug signal receptacle 20.

As seen in FIGS. 1–4, the plug lock 100 may include a plug lock boss 105 and a plug lock spring portion 110. The plug lock boss 105 may have first plug lock boss portion 106 and a second plug lock boss portion 107. The first plug lock boss portion 106 may correspond to the indentation 12 of the plug 10. The second plug lock boss portion 107 may have a notch 108 that corresponds to the plug lock locking mechanism 400 and allows the plug lock locking mechanism 400 to lock and secure the first plug lock boss portion 106 in the indentation 12 when the plug 10 is fully inserted in the plug signal receptacle 20. The plug lock spring portion 110 is attached to the second plug lock boss portion 107 on the opposite side of the notch 108. The plug lock spring portion 110 may be rotatably attached to the first selected point or axis 101 and communicates with the plug lock spring 200. As seen in FIG. 1, the plug lock boss 105 and the plug lock spring portion 110 may be perpendicular to each other and form a L-shape. The plug lock spring portion 110 may include a first plug lock spring end portion 111 and a second plug lock spring end portion 112. The fist plug lock spring end portion 111 may be rounded while the second plug lock spring end portion 112 may be attached to the second plug lock boss portion 107. In the fully inserted position, the plug lock 100 may envelope all or a portion of the indentation 12. The plug lock 100 may also have various detents located throughout the first plug lock boss portion 106.

As seen in FIG. 1, the locking release mechanism 300 may include a plug lock arm 305, a locking release mechanism arm 310, a locking release mechanism main member 315, and a locking release mechanism spring 320. The plug lock arm 305 and the locking release mechanism arm 310 may be located on opposite en of the locking release mechanism main member 315. Both the plug lock arm 305 and the locking release mechanism arm 310 may be pivotally attached to the locking release mechanism main member 315. The plug lock arm 305 may include a first plug lock arm end portion 306 and a second plug lock arm end portion 307. The first plug lock arm end portion 306 may have a fluke or have substantially a triangular shape. In the preferred embodiment, as seen in FIG. 1 the first plug lock arm end portion 306 communicates with the second plug lock boss portion 107, while the second plug lock arm end portion 307 is pivotally or rotatably attached to the locking release mechanism main member 315. The locking release mechanism arm 310 may include a fast locking release mechanism arm and portion 311 and a second locking release mechanism arm end portion 312. In one of the embodiments, as seen in FIG. 1, the fist locking release mechanism arm end portion 311 communicates with the plug lock locking mechanism 400, while the second locking release mechanism arm end portion 312 is pivotally or rotatably attached to the locking release mechanism main member 315. The locking release mechanism spring 320 may also communicate with the second locking release mechanism arm end portion 312 and/or the locking release mechanism main member 315. As seen in FIGS. 1 and 2, the first locking release mechanism arm end portion 311 may also rotate about a third selected point or axis 302.

In one of the embodiments of the invention, the apparatus for locking a plug 10 may include two or more plug locks 100, two or more plug lock springs 200, and two or more locking release mechanisms 300. When utilizing two of each element, the two plug locks 100 may be disposed on opposite sides of the plug signal receptacle 20.

The plug lock locking mechanism 400 may include a plug lock locking mechanism arm 405, a plug lock locking mechanism base 410 and a plug lock locking mechanism spring 415. Tre plug lock locking mechanism arm 405 may include a first plug lock locking mechanism arm end portion 406 and a second plug lock locking mechanism arm end portion 407. The first plug lock locking mechanism arm end portion 406 corresponds to the notch 108 in the second plug lock boss portion 107. The second plug lock locking mechanism arm end portion 407 is attached to the plug lock locking mechanism base 410. The plug lock locking mechanism base 410 communicates with the plug lock looking mechanism spring 415. The plug lock locking mechanism arm 405 may also include a gain 408. The gain 408 may be larger than the cross section of the first locking release mechanism arm end portion 311. The first locking release mechanism arm end portion 311 or a portion thereof may be disposed within the gain 408. As see n in FIG. 1, in the neutral position without a plug 10 fully engaged in the plug signal receptacle 20, the locking release mechanism spring 320 exerts force upon the locking release mechanism arm 310 causing the bottom of the first locking release mechanism arm end portion 311 to press on the lower portion of the gain 408, opposing the force of the plug lock locking mechanism spring 415.

The plug lock spring 200 and/or the locking release mechanism spring 320 and/or the plug lock locking mechanism spring 415 may be an extension, compression, die, torsion, Belleville disc or any other type of spring. The springs (200, 320, 415) may be manufactured from high-carbon steel, stainless steel, a nonferrous alloy, brass, or any material that lends itself to the manufacture of a spring.

The apparatus for locking a plug 10 may also include an electromagnet 500. The electromagnet 500 magnetically communicates with the plug lock locking mechanism 400 such that when the electromagnet 500 is activated the plug lock locking mechanism 400 is attracted to the electromagnet and the plug lock 100 no longer retains and holds the plug 10 securely in the plug signal receptacle 20. In one of the preferred embodiments there are two electromagnets 500 located on opposite ends of the plug lock locking mechanism base 410.

In operation, in the preferred embodiment, as seen in FIG. 2, when the plug 10 enters the plug signal receptacle 20, the truncated conic section tip 11 presses against the plug lock boss 105 which casses the plug lock 100 to rotate or pivot about the first selected point or axis 101. The second plug lock boss portion 107 presses against the tip of first plug lock arm end portion 306, causing the plug lock arm 305 and the locking release mechanism arm 310 to rotate or pivot about the second selected point or axis 301 and the third selected point or axis 302. As seen in FIG. 3 this then allows the plug lock locking mechanism 400 to go upward due to the plug lock locking mechanism spring 415 and the bottom of the first locking release mechanism arm end portion 311 no longer pressing on the lower portion of the gain 408, and opposing the force of the plug lock locking mechanism spring 415. As the plug 10 is fully engaged, the plug lock spring 200 then pushes the first plug lock boss portion 106 into the indentation 12. At or about the same time the first plug lock locking mechanism arm end portion 406 enters into the notch 108 locking the plug 10 into the plug signal receptacle 20. In order to unlock the plug 10 from the plug signal receptacle 20 the electromagnets 500 are activated, and then the electromagnets 500 pull the first plug lock locking mechanism arm end portion 406 away from the notch 108.

In one of the embodiments, there are two locking release mechanism springs 320 located at opposite side portions of the locking release mechanism arm 310. However, multiple springs may be used. In the preferred embodiment, the total tensile strength of the locking release mechanism springs 320 equals the tensile strength of plug lock locking mechanism spring 415 and the total tensile strength of the electromagnet 500 must be twice that of plug lock locking mechanism spring 415.

When introducing elements of the present invention or the preferred embodiment(s) thereof, the articles "a," "an," "the," and "said" are intended to mean there are one or more of the elements. The terms "comprising," "including," and "having" are intended to be inclusive and mean that there may be additional elements other than the listed elements.

Although the present invention has been described in considerable detail with reference to certain preferred versions thereof, other versions are possible. Therefore, the spirit and scope of the appended claims should not be limited to the description of the preferred versions contained herein.

What is claimed is:

1. An apparatus for locking a plug, the apparatus for use with a plug and a plug signal receptacle, the apparatus for locking a plug comprising:

a. a plug lock rotatably secured about a first selected point, the plug lock rotates about the first selected point as the plug enters the plug signal receptacle;

b. a plug lock spring, the plug lock communicating with the plug lock spring such that the plug lock spring applies force on the plug lock such that the plug lock returns to a neutral position after the plug is fully engaged in the plug signal receptacle;

c. a locking release mechanism, the locking release mechanism rotatably secured about a second selected point and a third selected point, the locking release mechanism communicates with the plug lock such that when the plug lock rotates about the first selected point the locking release mechanism rotates about the second selected point and the third selected point;

d. a plug lock locking mechanism, the plug lock locking mechanism communicates with the locking release mechanism such that when the locking release mechanism rotates about the second selected point and the third selected point the plug lock locking mechanism secures the plug lock in the neutral position, and the plug lock then retains and holds the plug securely in the plug signal receptacle; and e. an electromagnet, the electromagnet electromagnetically communicating with the plug lock locking mechanism such that when the electromagnet is activated the plug lock no longer retains and holds the plug securely in the plug signal receptacle.

2. An apparatus for locking an audio headphone plug, the apparatus for use with a headphone, a headphone plug, and an audio signal receptacle, the apparatus for locking an audio headphone plug comprising:

a. a plug lock rotatably secured about a first selected axis, the plug lock rotates about the first selected axis as the headphone plug enters the audio signal receptacle;

b. a plug lock spring the plug lock communicating with the plug lock spring such that the plug lock spring applies force on the plug lock such that the plug lock returns to a neutral position after the headphone plug is fully engaged in the audio signal receptacle, the neutral position being the plug lock is substantially perpendicular to the audio signal receptacle;

c. a locking release mechanism, the locking release mechanism rotatably secured about a second selected axis and, the locking release mechanism communicates with the plug lock such that when the plug lock rotates about the first selected axis the locking release mechanism rotates about the second selected axis and the third selected axis;

d. a plug lock locking mechanism, the plug lock locking mechanism communicates with the locking release mechanism such that when the locking release mechanism rotates about the second selected axis and the third selected axis the plug lock locking mechanism secures the plug lock in the neutral position, and the plug lock then retains and holds the headphone plug securely in the audio signal receptacle; and e. an electromagnet, the electromagnet electromagnetically communicating with the plug lock locking mechanism such then when the electromagnet is activated the plug lock no longer retains and holds the headphone plug securely in the audio signal receptacle.

3. An apparatus for locking an audio headphone plug, the apparatus for use with a headphone, a headphone plug, and an audio signal receptacle, the apparatus for locking an audio headphone plug comprising:

a. a plug lock rotatably secured about a first selected axis, the plug lock rotates about the first selected axis as the headphone plug enters the audio signal receptacle;

b. a plug lock spring, the plug lock communicating with the plug lock spring such that the plug lock spring applies force on the plug lock such that the plug lock returns to a neutral position after the headphone plug is fully engaged in the audio signal receptacle, the neutral position being the plug lock is substantially perpendicular to the audio signal receptacle;

c. a locking release mechanism, the locking release mechanism rotatably secured about a second selected axis and a third selected axis, the locking release mechanism communicates with the plug lock such that when the plug lock rotates about the first selected axis the locking release mechanism rotates about the second selected axis and the third selected axis, the locking release mechanism comprises a plug lock arm, a locking release mechanism, a locking release mechanism main member, and a locking release mechanism spring, the plug lock arm and the locking release mechanism arm are pivotally attached to the locking release mechanism main member, the locking release mechanism spring communicating with the locking release mechanism arm;

d. a plug lock locking mechanism, the plug lock locking mechanism communicates with the locking release mechanism such that when the locking release mechanism rotates about the second selected axis and the third selected axis the plug lock locking mechanism secures the plug lock in the neutral position, and the plug lock then retains and holds the headphone plug securely in the audio signal receptacle; and e. an electromagnet, the electromagnet electromagnetically communicating with the plug lock locking mechanism such then when the electromagnet is activated the plug lock no longer retains and holds the headphone plug securely in the audio signal receptacle.

4. The apparatus for locking an audio headphone plug of claim 3, wherein the apparatus for locking an audio headphone plug further comprises at least two plug locks, at least two plug lock springs and at least two locking release mechanism springs.

5. The apparatus for locking an audio headphone plug of claim 4, wherein the apparatus for locking an audio headphone plug further comprises at least two electromagnets.

6. The apparatus for locking an audio headphone plug of claim 5, wherein the plug lock locking mechanism comprises a plug lock locking mechanism spring, the total tensile strength of the locking release mechanism springs equals the tensile strength of the plug lock locking mechanism spring.

7. The apparatus for locking an audio headphone plug of claim 6, wherein the total tensile strength of the electromagnets is twice that of the plug lock locking mechanism spring.

* * * * *

UNITED STATES PATENT AND TRADEMARK OFFICE

CERTIFICATE OF CORRECTION

PATENT NO. : 6,790,070 B1
DATED : September 14, 2004
INVENTOR(S) : Donald H. England, II It is certified that error appears in the above-identified patent and that said Letters Patent is hereby corrected as shown below:

Column 2,
Line 48, should read -- truncated conic section tip 11 are typically on opposite ends of --
Line 60, should read -- selected point or axis 101. In operation, as seen in FIG. 2, the --

Column 3,
Line 49, should read -- may be located on opposite ends of the locking release --
Lines 62-63, should read -- mechanism arm 310 may include a first locking release mechanism arm end portion 311 and a second locking --

Column 4,
Line 18, should read -- spring 415. The plug lock locking mechanism arm 405 may --
Line 26, should read -- nism base 410 communicates with the plug lock locking --
Line 33, should read -- disposed within the gain 406. As seen in FIG. 1 in the --

Column 5,
Line 20, should read -- 320 equals the tensile strength of the plug locking mecha- --

Signed and Sealed this

Twenty-first Day of December, 2004

JON W. DUDAS
*Director of the United States Patent and Trademark Office*